US005226951A

United States Patent [19]

Kepplinger et al.

[11] Patent Number: 5,226,951

[45] Date of Patent: Jul. 13, 1993

[54] METHOD OF STARTING A PLANT FOR THE PRODUCTION OF PIG IRON OR STEEL PRE-MATERIAL AS WELL AS ARRANGEMENT FOR CARRYING OUT THE METHOD

[75] Inventors: Werner-Leopold Kepplinger, Leonding-Hart, Austria; Rolf Hauk; Bogdan Vuletic, both of Düsseldorf, Fed. Rep. of Germany; Felix Wallner; Walter-Rainer Kastner, both of Linz, Austria

[73] Assignee: Deutsche Voest-Alpine Industrieanlagenbav, Fed. Rep. of Germany

[21] Appl. No.: 837,757

[22] Filed: Feb. 19, 1992

[30] Foreign Application Priority Data

Feb. 19, 1991 [AT] Austria ..... 348/91

[51] Int. Cl.[5] ..... C21B 7/08

[52] U.S. Cl. ..... 75/443; 266/197

[58] Field of Search ..... 75/443, 491, 492; 266/168, 172, 174, 197

[56] References Cited

U.S. PATENT DOCUMENTS 4,244,732 1/1981 Brauns ..... 75/491
4,448,402 5/1984 Weber et al. ..... 75/492
4,891,062 1/1990 Vuletic et al. ..... 75/492

FOREIGN PATENT DOCUMENTS 3727146 9/1988 Fed. Rep. of Germany .

*Primary Examiner*—Scott Kastler
*Attorney, Agent, or Firm*—Ostrolenk, Faber, Gerb & Soffen

[57] ABSTRACT

There is disclosed a method of starting a plant for the production of pig iron or steel pre-material including a direct-reduction shaft furnace and a meltdown gasifier.

At first the still empty meltdown gasifier is heated up by aid of a combustible gas and the smoke gases forming are introduced into the still empty direct-reduction shaft furnace.

Coke or a degassed coal product is charged into the direct-reduction shaft furnace and the smoke gases introduced into the direct-reduction shaft furnace are passed through the coke or the degassed coal product by releasing their sensible heat.

The coke or the degassed coal product thereby is heated to ignition temperature and is charged into the meltdown gasifier in the hot state, catching fire upon the injection of an oxygen-containing gas or of oxygen.

A further coal or coke bed serving for gasification is charged on the ignited bed of coke or degassed coal product and the charging substances are charged into the direct-reduction shaft furnace.

8 Claims, 3 Drawing Sheets

METHOD OF STARTING A PLANT FOR THE PRODUCTION OF PIG IRON OR STEEL PRE-MATERIAL AS WELL AS ARRANGEMENT FOR CARRYING OUT THE METHOD

The invention relates to a method of starting a plant for the production of pig iron or steel pre-material, in which production particulate charging substances are reduced by a reducing gas in a direct-reduction shaft furnace, the sponge iron particles obtained are smelted in a meltdown gasifier under supply of carbon carriers and oxygen-containing gas at the simultaneous formation of reducing gas and the reducing gas is injected into the direct-reduction shaft furnace, as well as to an arrangement for carrying out the method.

From DE-C-3 727 146, a method for starting a gasifier for gasifying carbonaceous fuels by aid of an oxygen-containing gasifying agent is known, in which a combustible gas mixture is ignited and burnt under overpressure in a combustion chamber communicating with the lower part of the gasifier. However, by a method of this type it is only possible to heat the gasifier to a temperature approximately corresponding to the gasifying temperature, which is about 800° to 1,000° C.

Yet, substantially higher starting temperatures are required to start a plant of the initially defined kind, because the process temperatures within a meltdown gasifier are much higher. Thus, the gasifying temperature amounts to about 2,000° C., the temperature prevailing in the sump region of the meltdown gasifier is about 1,500° C. and the temperature in the region of the tap openings for slag and pig iron is at least 1,350° C.

It is the object of the invention to provide a method of starting a plant for the production of pig iron or steel pre-material according to the intially defined kind, by which high temperatures, in particular those pointed out above, within the meltdown gasifier as well as sufficient heating of the direct-reduction shaft furnace may be attained.

In accordance with the invention, this object is achieved in that

- at first the still empty meltdown gasifier is heated up by means of a combustible gas and the smoke gases forming are introduced into the still empty direct-reduction shaft furnace,
- coke or a degassed coal product is charged into the direct-reduction shaft furnace and the smoke gases introduced into the direct-reduction shaft furnace are passed through the coke or the degassed coal product by releasing their sensible heat,
- the coke or the degassed coal product thereby is heated to ignition temperature and is charged into the meltdown gasifier in the hot state, catching fire upon the injection of an oxygen-containing gas or of oxygen,
- whereupon a further coal or coke bed that serves for gasification is charged onto the ignited bed of coke or degassed coal product and the charging substances are charged into the direct-reduction shaft furnace.

To realize this method, the oxygen-containing gas or the ogygen suitably is supplied through a lost pipe duct disposed on the bottom of the meltdown gasifier prior to starting the plant, i.e., one that melts during operation of the plant. Thereby, it is feasible in a particularly simple manner to supply only that gas which is necessary in starting, without expensive additional means being required.

An arrangement for carrying out the method according to the invention

- comprising a direct-reduction shaft furnace including at least one charging substance supply duct for lumpy iron ore, at least one feed duct for a reducing gas as well as at least one duct for the reduction product formed therein and a discharge duct for top gas formed therein, and
- comprising a meltdown gasifier, into which the duct supplying the reduction product from the direct-reduction shaft furnace runs and which includes feed ducts for oxygen-containing gases and carbon carriers as well as a feed duct running into the direct-reduction shaft furnace for reducing gas formed in it as well as taps for pig iron and slag, is characterized in that a valve, such as a butterfly valve, is provided within the reducing gas feed duct and that the meltdown gasifier is equipped with at least one heat-up burner.

According to a preferred embodiment, a gas pipe duct of a material that melts approximately at the melting temperature of the pig iron, preferably made of steel, is arranged on the bottom of the initially empty meltdown gasifier, projecting outwardly through a side wall opening of the meltdown gasifier by a connection piece.

Suitably, the heat-up burner is attachable to, and removable from, the meltdown gasifier in the first third of the height of the meltdown gasifier.

BRIEF DESCRIPTION OF THE DRAWINGS

In the following, the invention will be explained in more detail by way of one embodiment with reference to the accompanying drawing, wherein.

Figure 1:
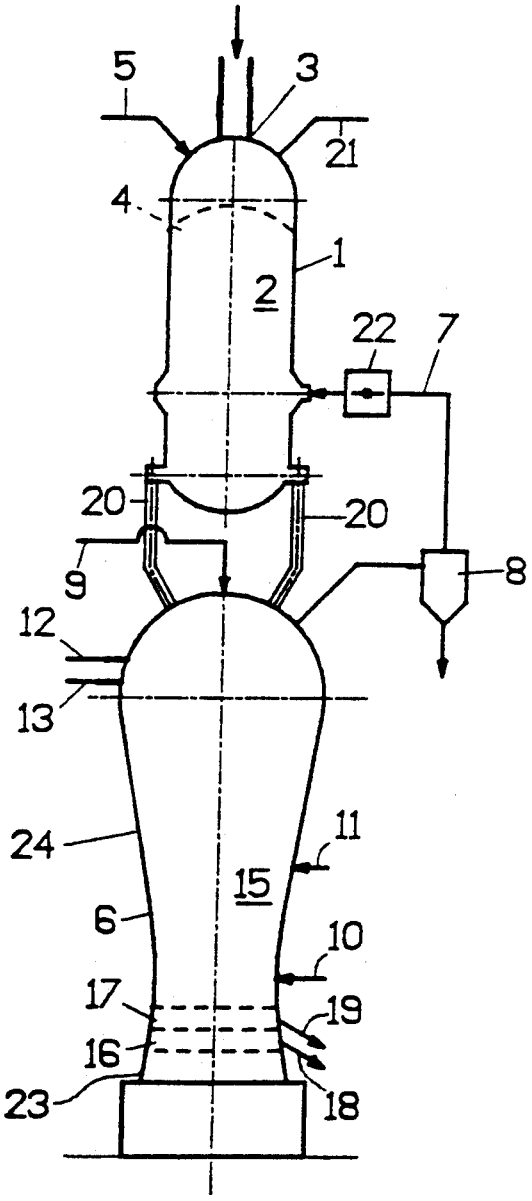
FIG. 1 is a schematic illustration of a plant for the production of pig iron in the operating state.

By 1, a direct-reduction shaft furnace is denoted, into whose direct-reduction zone 2 lumpy iron-oxide containing charging substances 4, if desired, together with unburnt fluxes introduced via a supply duct 5, are top-charged through a supply duct 3. The shaft furnace 1 is in communication with a meltdown gasifier 6, in which a reducing gas is produced from carbon carriers and oxygen-containing gas, which reducing gas is fed to the shaft furnace 1 via a feed duct 7, in which a gas scrubbing and a gas cooling means 8 are provided.

The meltdown gasifier 6 incorporates a supply duct 9 for solid lumpy carbon carriers, if desired, several feed ducts 10, 11 for oxygen-containing gases and supply ducts 12, 13 for carbon carriers, such as hydrocarbons, which are in the liquid or gaseous state at room temperature, as well as for burnt fluxes. Molten pig iron 16 and molten slag 17 each tapped via a separate tap 18, 19 collect in the meltdown gasifier 6 below the meltdown gasifying zone 15.

The lumpy ore reduced to sponge iron in the direct-reduction zone 2 of the shaft furnace 1, together with the fluxes burnt in the direct-reduction zone 2, is supplied through ducts 20 connecting the shaft furnace 1 with the meltdown gasifier 6, for instance, by means of delivery worms (not illustrated). A discharge duct 21 for the top ga formed in the direct-reduction zone 2 follows upon the upper part of the shaft furnace 1.

One valve 22, which is designed as a butterfly valve, is provided in each feed duct 7. In the lower region of the meltdown gasifier 6, approximately at the height of the transition from the cylindrical part 23 into the superimposed widening part 24, external heat-up burners 25 are provided, which can be operated with coke gas or natural gas (cf. FIGS. 2 to 4). These heat-up burners are in operation only during heat-up and may be removed from the meltdown gasifier 6 after the plant has been set into operation.

Figure 2:
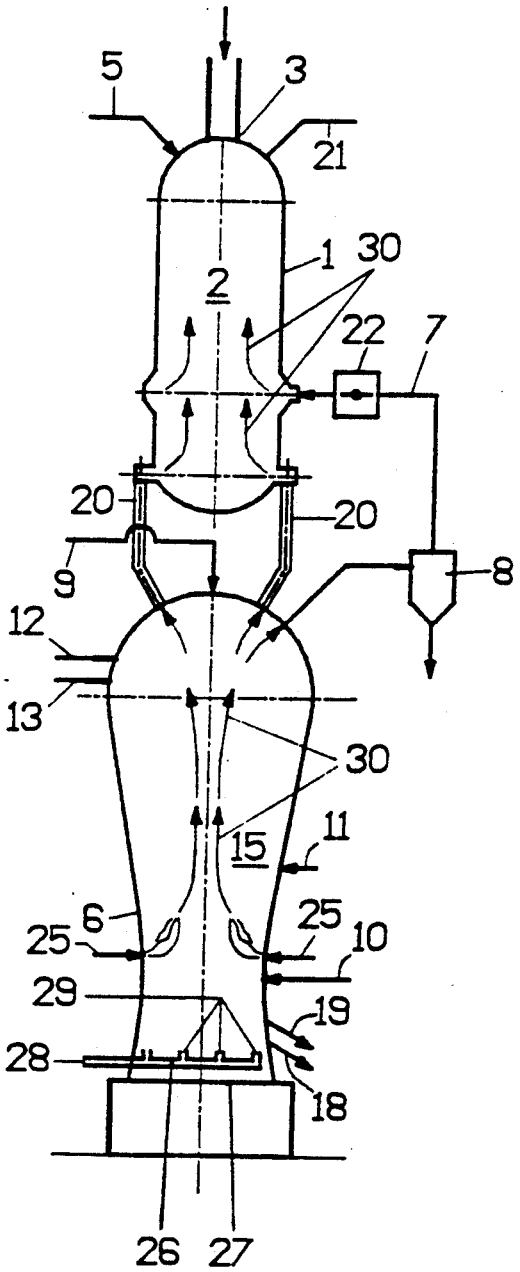
FIGS. 2 to 5 illustrate this plant according to one method step each carried out to set this plant into operation.

To set the plant into operation, it is proceeded in the following manner:

At first, a gas duct 26 is introduced into the still cold and empty meltdown gasifier 6 (cf. FIG. 2). This gas duct 26 is disposed on the bottom 27 of the meltdown gasifier 6 and runs outwardly by a connection piece 28 at one point through a side wall opening of the meltdown gasifier 6. The gas pipe duct 26 is made of steel pipes provided with gas outlets 29 on their upper sides and uniformly extending over approximately the entire bottom surface in several concentric rings or in the form of a fan. The function of this gas pipe duct 26 will be explained in more detail by way of FIG. 3 later on.

After having laid the gas pipe duct 26, the heat-up burners 25 are switched on. The smoke gases 30 forming serve to heat the refractory brickwork of the empty meltdown gasifier 6 according to the respective heat-up conditions and flow through the feed ducts 7, whose butterfly valves are in the opened state, and through ducts 20 into the still empty direct-reduction shaft furnace 1, drying and also heating the latter. This situation is represented in FIG. 2.

Figure 3:
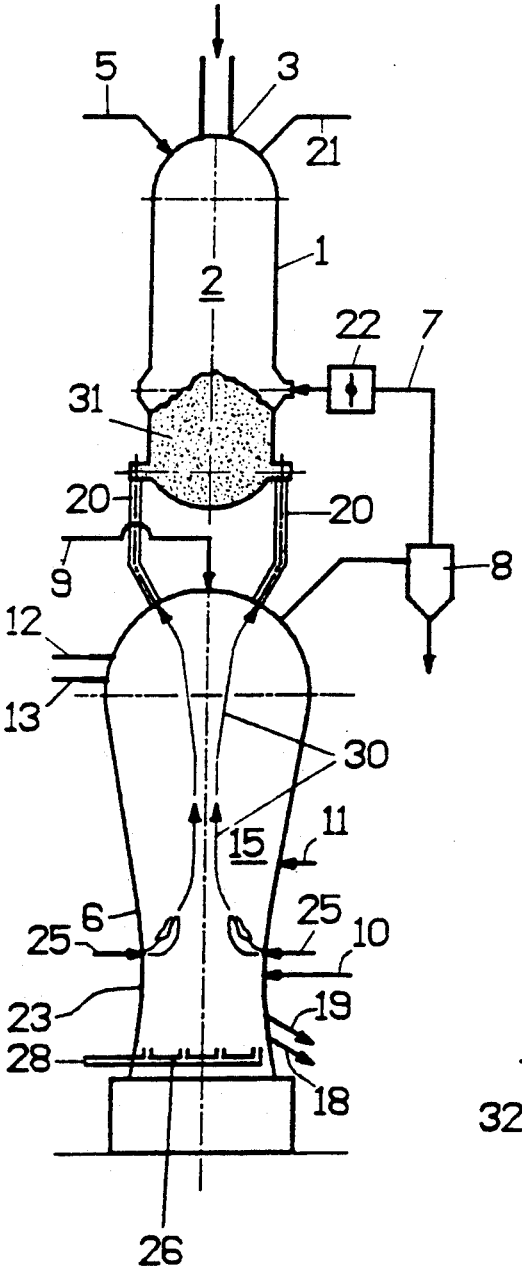

After this, and as illustrated in FIG. 3, coke 31 or a degassed coal product, such as, for instance, broken electrodes or oil coke, is charged into the direct-reduction shaft furnace 1. The amount of coke 31 approximately corresponds to the volume of the lower cylindrical part 23 of the meltdown gasifier 6. In order to make sure that the smoke gases 30 forming during the continued heating by aid of the heat-up burners 25 stream through the charged coke 31 and do not take the way of least resistance through the feed ducts 7, the butterfly valves 22 are closed. The smoke gases then flow through the ducts 20 by 100%, heating the coke 31 to ignition temperature, which is about 650° C.

Figure 4:
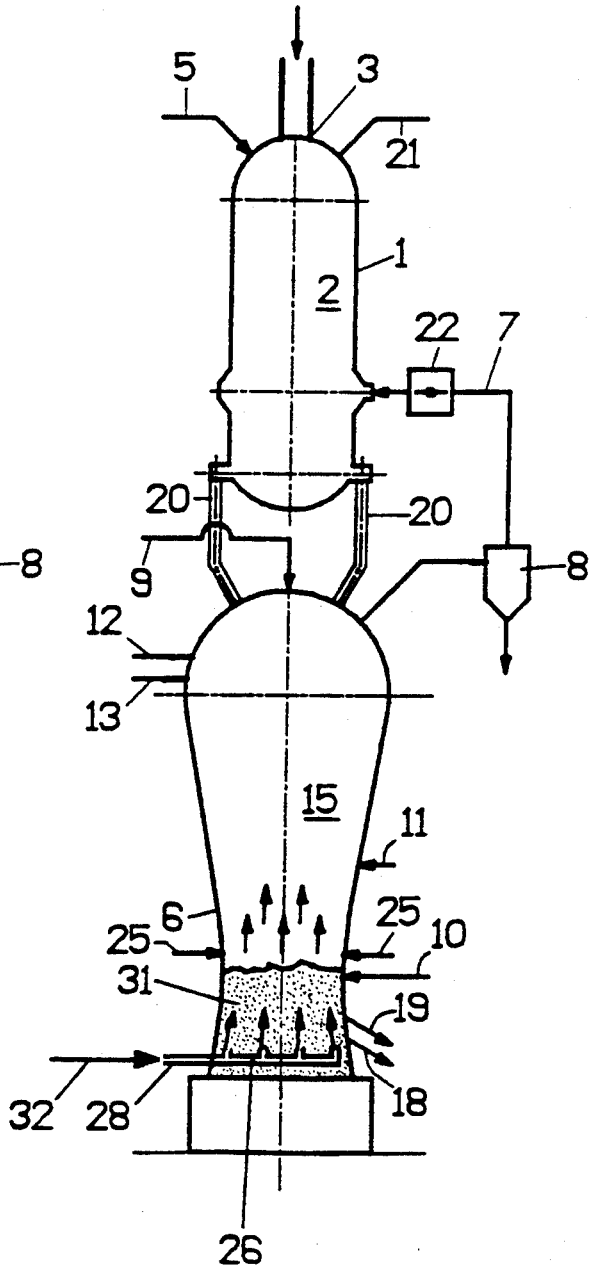

After having reached the point of ignition, the coke 31 is introduced into the meltdown gasifier 6 through ducts 20. At the same time, air 32 or oxygen is conducted through the gas duct 26, the coke 31 thus catching fire and burning. In doing so, temperatures of about 1,200° C. to 1,500° C. are produced. This situation is represented in FIG. 4.

Figure 5:
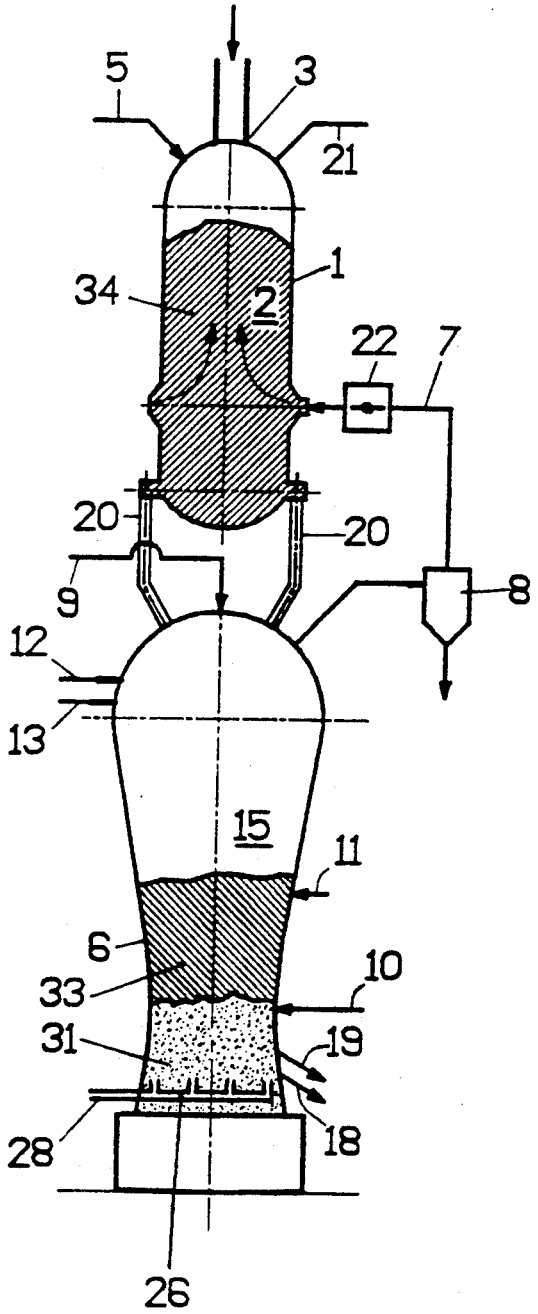

After having reached this temperature, the heat-up burners 25 are switched off and removed (FIG. 5). The elevated temperature safeguards the molten state of the slag 17 and of the pig iron 16 in the subsequent smelting operation.

After the subsequent charging of fine coke or fine coal 33, which are to be charged in the cold state, onto the coke bed 31 already present within the meltdown gasifier 6, the fine coke or fine coal 33 is brought to its point of ignition by blowing in additional bottom air through the gas pipe duct 26, gasification within the meltdown gasifier 6 starting in the conventional manner after the feed ducts 10 and 11 as well as, if desired, the supply ducts 12, 13 have been set into operation. At that time, the charging of starting burden 34, which contains HO slag, optionally sponge iron, additives (lime, dolomite), optionally fluxes ($CaF_2$) and ores, into the direct-reduction shaft furnace 1 is started. The reducing gases forming during gasification within the meltdown gasifier 6 are introduced into the direct-reduction shaft furnace 1 for the reduction of ore through ducts 7 in a known manner after having opened the butterfly valves 22.

After gasification within the meltdown gasifier 6 has started, the gas pipe duct 26 is shut off, the end of this duct projecting outwardly through the side wall opening is pushed into the interior of the meltdown gasifier 6 and the side wall opening is closed. During further operation of the plant, the gas pipe duct 26 melts such that the melting operation will not be impaired.

What we claim is:

1. In a method of starting a plant for the production of pig iron or steel pre-material by reducing particulate charging substances by aid of a reducing gas in a direct-reduction shaft furnace so as to obtain sponge iron particles, smelting said sponge iron particles in a meltdown gasifier under supply of carbon carriers and oxygen-containing gas at the simultaneous formation of reducing gas and injecting said reducing gas into said direct-reduction shaft furnace, the improvement wherein an empty meltdown gasifier and an empty direct-reduction shaft furnace are provided, said empty meltdown gasifier being heated by a combustible gas under formation of smoke gases and said smoke gases being introduced into said empty direct-reduction shaft furnace, coke or a degassed coal product is charged into said direct-reduction shaft furnace and said smoke gases introduced into said direct-reduction shaft furnace are passed through said coke or degassed coal product, thus releasing their sensible heat, said coke or degassed coal product thereby is heated to ignition temperature and is charged into said meltdown gasifier in the hot state, an oxygen-containing gas or oxygen being injected into said meltdown gasifier so as to cause said coke or degassed coal product to form an ignited bed of coke of degassed coal product, a further coal or coke bed serving for gasification is charged onto said ignited bed of coke or degassed coal product, and said particulate charging substances are charged into said direct-reduction shaft furnace.

2. A method as set forth in claim 1, further comprising disposing a gas pipe duct on the bottom of said meltdown gasifier for feeding said oxygen-containing gas or oxygen into said meltdown gasifier prior to starting the plant for the production of pig iron or steel pre-material, which gas pipe duct gets lost during operation of said plant.

3. An arrangement for starting a plant for the production of pig iron or steel pre-material, comprising a direct-reduction shaft furnace having at least one charging substance supply duct for lumpy iron ore, at least one reducing gas feed duct as well as at least one reduction product duct for the reduction product formed in said direct-reduction shaft furnace and a top gas discharge duct for top gas formed in said direct-reduction shaft furnace, and a meltdown gasifier, into which said reduction product duct runs for supplying the reduction product from said direct-reduction shaft furnace, said meltdown gasifier having feed duct means for oxygen-containing gases and carbon carriers as well as a reducing gas feed duct running into said direct-reduction shaft furnace and provided to feed reducing gas formed in said meltdown gasifier, as well as pig iron and slag tap means, the improvement comprising a valve provided within said reducing gas feed duct and at least one heat-up burner provided for said meltdown gasifier.

4. An arrangement as set forth in claim 3, wherein said valve is comprised of a butterfly valve.

5. An arrangement as set forth in claim 3, further comprising a gas pipe duct made of a material melting approximately at the melting temperature of pig iron and provided on the bottom of said meltdown gasifier, said meltdown gasifier being initially empty and having a side wall opening, and said gas pipe duct including a connection piece projecting outwardly from said meltdown gasifier through said side wall opening.

6. An arrangement as set forth in claim 5, wherein said gas pipe duct is made of steel.

7. An arrangement as set forth in claim 3, wherein said heat-up burner is provided in the first third of said meltdown gasifier in terms of height and is attachable to, and removable from, said meltdown gasifier.

8. A method as set forth in claim 2, wherein said gas pipe duct melts during operation of said plant.

* * * * *

UNITED STATES PATENT AND TRADEMARK OFFICE

CERTIFICATE OF CORRECTION

PATENT NO. : 5,226,951

DATED : July 13, 1993

INVENTOR(S) : Kepplinger et al.

It is certified that error appears in the above-identified patent and that said Letters Patent is hereby corrected as shown below:

On the title page

Please change Assignee from "Deutsche Voest-Alpine Industrieanlagenbav"

to --Deutsche Voest-Alpine Industrieanlagenbau GmbH--

Signed and Sealed this

Thirty-first Day of May, 1994

Bruce Lehman

*Attest:*

BRUCE LEHMAN

*Attesting Officer*

*Commissioner of Patents and Trademarks*